US011181085B2

(12) United States Patent
Sumimoto et al.

(10) Patent No.: US 11,181,085 B2
(45) Date of Patent: Nov. 23, 2021

(54) FUEL SUPPLY DEVICE FOR ENGINE

(71) Applicant: Mazda Motor Corporation, Hiroshima (JP)

(72) Inventors: Hiroshi Sumimoto, Aki-gun (JP); Tomohiro Sunada, Higashihiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 16/960,799

(22) PCT Filed: Dec. 11, 2018

(86) PCT No.: PCT/JP2018/045443
§ 371 (c)(1),
(2) Date: Jul. 8, 2020

(87) PCT Pub. No.: WO2019/150775
PCT Pub. Date: Aug. 8, 2019

(65) Prior Publication Data

US 2021/0054814 A1 Feb. 25, 2021

(30) Foreign Application Priority Data

Feb. 2, 2018 (JP) ..... JP2018-016967

(51) Int. Cl.
*F02M 55/02* (2006.01)

(52) U.S. Cl.
CPC ..... *F02M 55/02* (2013.01); *F02M 55/025* (2013.01); *F02M 2200/8015* (2013.01)

(58) Field of Classification Search
CPC ..... F02M 2200/80; F02M 2200/8015; F02M 2200/85; F02M 2200/852;
(Continued)

(56) References Cited

U.S. PATENT DOCUMENTS

2004/0050364 A1* 3/2004 Yanagii ..... F02M 55/025 123/456
2004/0194761 A1* 10/2004 Ando ..... F02M 55/025 123/456
(Continued)

FOREIGN PATENT DOCUMENTS

DE 102004021040 A1 11/2005
DE 102004053947 A1 * 5/2006 ..... F02M 55/02
(Continued)

OTHER PUBLICATIONS

European Patent Office, Extended European Search Report Issued in Application No. 18903448.1, dated Mar. 2, 2021, Germany, 8 pages.

*Primary Examiner* — John M Zaleskas
(74) *Attorney, Agent, or Firm* — Alleman Hall Creasman & Tuttle LLP

(57) ABSTRACT

Present application discloses fuel supply device which includes: fuel injection valves respectively arranged on center axes of cylinders, fuel injection valves being configured to inject fuel into the cylinders; fuel distribution portion configured to distribute fuel to fuel injection valves; and fuel supply tubes configured to form supply paths for fuel from fuel distribution portion to fuel injection valves. Fuel distribution portion includes connection portions arranged in arrangement direction so as to be connected to fuel supply tubes. Connection portions include pair of reference connection portions situated at positions distant from each other in arrangement direction by distance between respective bore center axes of cylinders. Fuel supply tubes include pair of fuel supply tubes respectively connected to pair of reference connection portions and two fuel injection valves on two cylinders arranged adjacently to each other. Pair of fuel supply tubes have a common shape.

7 Claims, 4 Drawing Sheets

(58) Field of Classification Search
CPC ..... F02M 2200/856; F02M 55/005; F02M 55/02; F02M 55/025; F02M 63/0225; F02M 69/465
See application file for complete search history.

(56) References Cited

U.S. PATENT DOCUMENTS

| | | | | |
|---|---|---|---|---|
| 2006/0000452 | A1* | 1/2006 | Tokuda | F02M 63/0225 123/456 |
| 2006/0185649 | A1* | 8/2006 | Muench | F02M 63/025 123/447 |
| 2008/0210201 | A1* | 9/2008 | Akagi | F02M 69/042 123/469 |
| 2009/0159049 | A1* | 6/2009 | Sakagami | F02M 55/02 123/456 |
| 2009/0255511 | A1* | 10/2009 | Panchai | F02M 55/025 123/456 |
| 2011/0023818 | A1* | 2/2011 | Fulton | F02M 55/025 123/295 |
| 2012/0210980 | A1* | 8/2012 | Bedekar | F02M 55/004 123/456 |
| 2017/0350357 | A1* | 12/2017 | Touchette | F02M 21/0218 |
| 2018/0223780 | A1* | 8/2018 | Wickstone | F02D 19/0684 |
| 2019/0242348 | A1* | 8/2019 | Hirabayashi | F02M 69/465 |
| 2020/0240376 | A1* | 7/2020 | Engfehr | F02M 69/465 |

FOREIGN PATENT DOCUMENTS

| | | | | |
|---|---|---|---|---|
| DE | 102015214333 | A1 * | 2/2017 | F02M 55/005 |
| EP | 2347861 | A2 * | 7/2011 | F02M 61/14 |
| EP | 2347861 | A2 | 7/2011 | |
| JP | H04350357 | A | 12/1992 | |
| JP | 2002322966 | A | 11/2002 | |
| JP | 2004308512 | A | 11/2004 | |
| JP | 2007170209 | A | 7/2007 | |
| JP | 2014015890 | A | 1/2014 | |
| JP | 2015068219 | A | 4/2015 | |
| WO | WO-2012051506 | A1 * | 4/2012 | F02M 55/005 |
| WO | 2016095054 | A1 | 6/2016 | |
| WO | 2017020131 | A1 | 2/2017 | |

* cited by examiner

FUEL SUPPLY DEVICE FOR ENGINE

TECHNICAL FIELD

The present invention relates to a fuel supply device configured to supply fuel to an engine.

BACKGROUND ART

An engine generally has cylinders. In order to inject fuel into the cylinders of the engine, fuel supply paths are formed in the engine for supplying the fuel to fuel injection valves mounted on these cylinders. The fuel injection valves receive the fuel through the fuel supply paths and inject the fuel into the cylinders (c.f. Patent Document 1). Patent Document 1 discloses a fuel supply device having fuel supply tubes which form fuel supply paths from a fuel distribution pipe, fuel fed from a fuel pump being stored in the fuel distribution pipe.

The fuel supply tubes are designed mainly on the basis of the positions of the fuel injection valves and the positions of connection portions (i.e. portions to which the fuel supply tubes are connected) formed on the fuel distribution pipe. Generally, the fuel supply tubes are different in shape from each other every cylinder. Accordingly, various kinds of fuel supply tubes are assembled in the fuel supply device. An operator has to select fuel supply tubes having appropriate shapes from the various kinds of fuel supply tubes. In such selection of the fuel supply tubes, there may be a case where the operator selects a wrong fuel supply tube having an unintended shape and mounts the wrong fuel supply tube on the fuel supply device. Accordingly, the conventional fuel supply device has a structure which deteriorates efficiency of the assembling operation.

PRIOR ART DOCUMENT

Patent Document

Patent Document 1: JP 2007-170209 A

SUMMARY OF INVENTION

It is an object of the present invention to provide a fuel supply device designed so as to enhance efficiency of an assembling operation.

A fuel supply device according to one aspect of the present invention is configured to supply fuel to an engine having cylinders arranged at regular intervals in a predetermined arrangement direction. The fuel supply device includes: fuel injection valves respectively arranged on center axes of the cylinders, the fuel injection valves being configured to inject the fuel into the cylinders; a fuel distribution portion configured to distribute the fuel to the fuel injection valves; and fuel supply tubes configured to form supply paths for the fuel from the fuel distribution portion to the fuel injection valves. The fuel distribution portion includes connection portions arranged in the arrangement direction so as to be connected to the fuel supply tubes. The connection portions include a pair of reference connection portions situated at positions distant from each other in the arrangement direction by a distance between respective bore center axes of the cylinders. The fuel supply tubes include a pair of fuel supply tubes respectively connected to the pair of reference connection portions and two fuel injection valves on two cylinders arranged adjacently to each other. The pair of fuel supply tubes have a common shape.

The aforementioned fuel supply device may be efficiently assembled.

Object, technical features and advantageous effects of the present invention become more apparent with reference to the detailed description made hereinafter and the attached drawings.

DESCRIPTION OF EMBODIMENTS

First Embodiment

Figure 1:
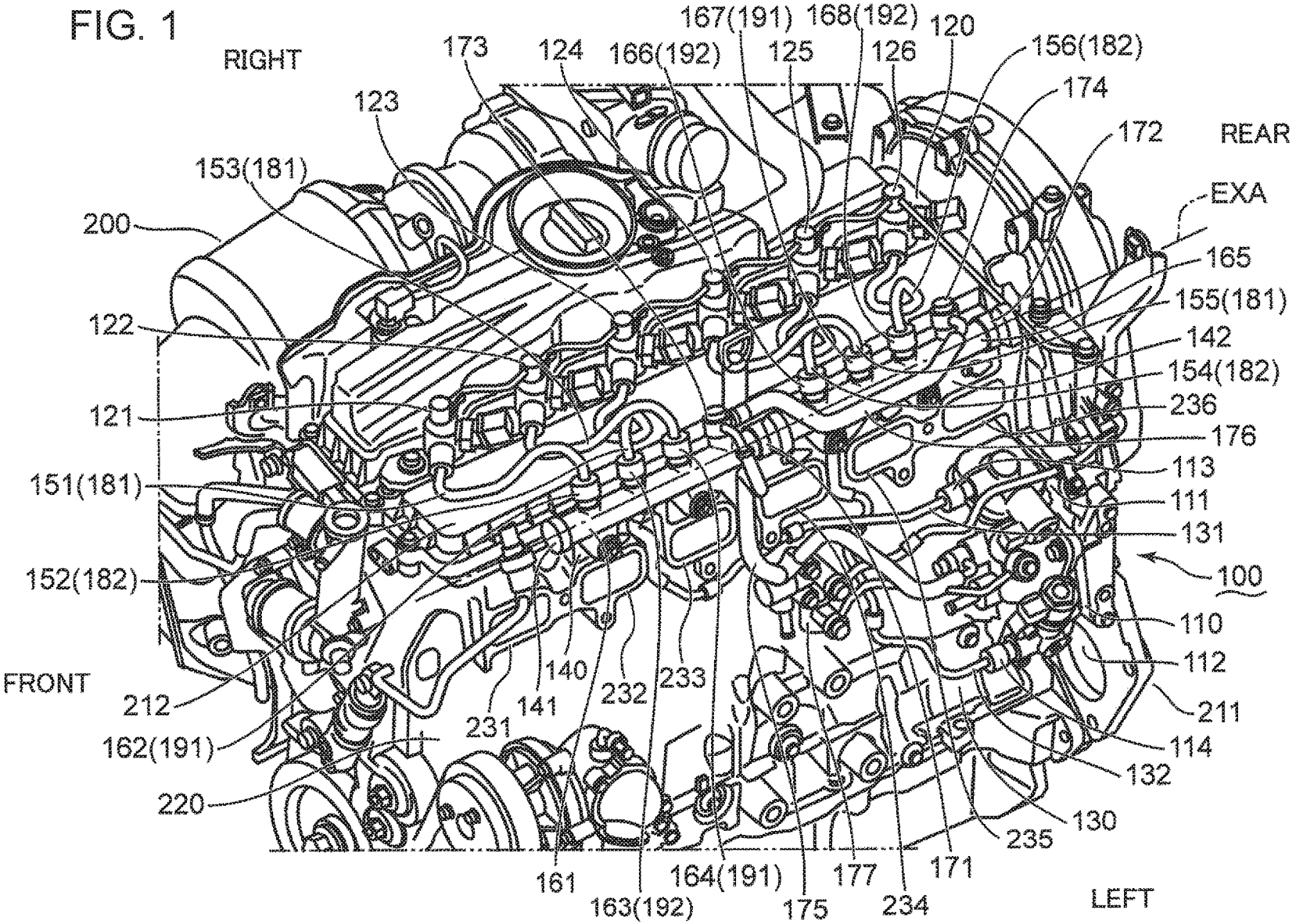
FIG. 1 is a schematic perspective view of a fuel supply device according to the first embodiment.

FIG. 1 is a schematic perspective view of a fuel supply device 100 according to the first embodiment for supplying fuel to an engine 200. Before the description of the fuel supply device 100, the engine 200 and peripheral equipment around the engine 200 are schematically described with reference to FIG. 1. The terms "upstream" and "downstream" are used with reference to a flowing direction of fuel. Directional terms such as "front", "rear", "right", "left", "up" and "down" are used only for the sake of clarity of the description and should not be construed in a limited manner.

<Engine>

The engine 200 is an in-line six-cylinder engine. The engine 200 includes a cylinder block 211 and a cylinder head 212. The cylinder block 211 forms six cylinders (first to sixth cylinders not shown), each of which opens upward and has a center axis extending vertically. The cylinder head 212 closes the open ends of the six cylinders. The six cylinders are arranged in the front-back direction.

The engine 200 has six pistons (not shown) which reciprocate in the vertical direction in the six cylinders, a crankshaft (not shown) which outputs the reciprocating movement of the six pistons as the rotating movement around a predetermined rotation axis, and a connecting mechanism (not shown) which connects the crankshaft and the six respective pistons to each other. The crankshaft extends in the front-back direction below the six pistons. The connecting mechanism includes connecting rods, piston rods and crossheads. General vehicle engine design techniques may be applied to the structure of the engine 200. Accordingly, the principle of this embodiment is not limited to the particular structure of the engine 200.

FIG. 1 shows a left surface 220 of the cylinder block 211 of the engine 200, and six intake ports 231 to 236 which protrude leftward from the left surface 220. The left surface 220 is used for mounting of the fuel supply device 100. The six intake ports 231 to 236 are used for feeding air to the six cylinders formed in the cylinder block 211.

The intake port 231 is formed at the frontmost side among the intake ports 231 to 236. The intake port 231 communicates with the first cylinder (not shown) formed at the frontmost side. The intake port 232 is formed behind the intake port 231 and communicates with the second cylinder (not shown) behind the first cylinder. The intake port 233 is formed behind the intake port 232, and communicates with the third cylinder (not shown) behind the second cylinder. The intake port 234 is formed behind the intake port 233, and communicates with the fourth cylinder (not shown) behind the third cylinder. The intake port 235 is formed behind the intake port 234, and communicates with the fifth cylinder (not shown) behind the fourth cylinder. The intake port 236 is formed at the rearmost side among the intake ports 231 to 236. The intake port 236 communicates with the sixth cylinder (not shown) formed at the rearmost side among the six cylinders (not shown).

A gap extending in the vertical direction is formed between the intake ports 232, 233, between the intake ports 233, 234, and between the intake ports 234, 235. These gaps are used for piping in the fuel supply device 100. The structure of the fuel supply device 100 is schematically described below.

<Structure of Fuel Supply Device>

The fuel supply device 100 includes: a fuel pump portion 110 mounted on the left surface 220 of the cylinder block 211; a valve group 120 mounted on the upper surface of the cylinder head 212; and a tube group 130 connecting the fuel pump portion 110 to the valve group 120. The fuel pump portion 110 sucks fuel from a fuel tank (not shown) and discharges the sucked fuel to the tube group 130. The tube group 130 forms fuel supply paths from the fuel pump portion 110 to the valve group 120. The valve group 120 injects the fuel to the aforementioned six cylinders.

The fuel pump portion 110 includes two pumps 111, 112 aligned in the vertical direction. The upper pump 111 includes a discharge portion 113 from which the fuel sucked from the fuel tank by the fuel pump portion 110 is discharged. The lower pump 112 includes a discharge portion 114 from which the fuel sucked from the fuel tank by the fuel pump portion 110 is discharged.

Two guide tubes 131, 132 extending from the discharge portions 113, 114, a fuel distribution portion 140 connected to these guide tubes 131, 132, and six fuel supply tubes 151 to 156 extending from the fuel distribution portion 140 to the valve group 120 are shown as the tube group 130 in FIG. 1. The guide tube 131 is connected to the discharge portion 113 of the upper pump 111, and extends forward and upward. The guide tube 131 extends through the gap between the intake ports 232, 233, and is connected to the fuel distribution portion 140 extending substantially horizontally above the intake ports 231 to 236. The guide tube 132 is connected to the discharge portion 114 of the lower pump 112, and extends forward and upward so as to intersect with the guide tube 131 stereoscopically. The guide tube 132 extends through the gap between the intake ports 234, 235, and is connected to the fuel distribution portion 140 extending substantially horizontally above the intake ports 231 to 236.

The fuel distribution portion 140 is used for temporarily storing the fuel supplied from the fuel pump portion 110 through the guide tubes 131, 132, and for distributing the fuel to the valve group 120. The fuel distribution portion 140 is a substantially cylindrical portion extending in the arrangement direction of the aforementioned cylinders (i.e. in the front-back direction) on the left side of the cylinder head 212 (i.e. above the cylinder block 211).

The fuel distribution portion 140 includes first and second distribution pipes 141, 142 which are situated substantially horizontally. An extension axis EXA shown in FIG. 1 is substantially coincident with the center axes of the first and second distribution pipes 141, 142. The extension axis EXA extends in the arrangement direction of the six cylinders, and is substantially in parallel to the cylinder row formed of the six cylinders. The first and second distribution pipes 141, 142 extend along the extension axis EXA.

The first distribution pipe 141 includes: a substantially cylindrical main pipe 161 extending along the extension axis EXA; and three connection portions 162, 163, 164 protruding upward from the main pipe 161. The guide tube 131 extending from the upper pump 111 is connected to the main pipe 161. The main pipe 161 forms a storage space (not shown) in which the fuel supplied through the guide tube 131 is temporarily stored. A pressure of the fuel in the main pipe 161 is increased as the upper pump 111 feeds the fuel. Accordingly, the main pipe 161 is designed to store high-pressure fuel. The high-pressure fuel in the main pipe 161 flows out from the connection portions 162, 163, 164.

The connection portion 162 is formed at the frontmost side among the connection portions 162, 163, 164. The connection portion 164 is formed at the rearmost side among the connection portions 162, 163, 164. The connection portion 163 is formed between the connection portions 162, 164. The fuel supply tubes 151, 152, 153 are connected to the connection portions 162, 163, 164 respectively to form the fuel supply paths to the valve group 120. The fuel supply tubes 154, 155, 156 situated behind the fuel supply tubes 151, 152, 153 are connected to the second distribution pipe 142 situated behind the first distribution pipe 141. The second distribution pipe 142 has a common shape with the first distribution pipe 141. In short, the second distribution pipe 142 is substantially equal to the first distribution pipe 141 in shape and structure. Accordingly, the description about the shape and the structure of the first distribution pipe 141 is applicable to the shape and the structure of the second distribution pipe 142.

The second distribution pipe 142 includes: a main pipe 165 extending along the extension axis EXA behind the main pipe 161 of the first distribution pipe 141; and three connection portions 166, 167, 168. The main pipe 165 is arranged in series with the main pipe 161 of the first distribution pipe 141. The guide tube 132 extending from the lower pump 112 is connected to the main pipe 165. The main pipe 165 forms a storage space (not shown) in which the fuel supplied through the guide tube 132 is temporarily stored independently from the storage space formed by the main pipe 161 of the first distribution pipe 141. A pressure of the fuel in the main pipe 165 is increased as the lower pump 112 feeds the fuel. Accordingly, the main pipe 165 is designed to store high-pressure fuel. The high-pressure fuel in the main pipe 165 flows out from the connection portions 166, 167, 168.

The connection portion 166 is formed at the frontmost side among the connection portions 166, 167, 168. The connection portion 168 is formed at the rearmost side among the connection portions 166, 167, 168. The connection portion 167 is formed between the connection portions 166, 168. The fuel supply tubes 155, 154, 156 are connected to the connection portions 166, 167, 168 respectively to form the fuel supply paths to the valve group 120.

Six fuel injection valves 121 to 126 are fixed to the upper surface of the cylinder head 212 in correspondence to the six fuel supply tubes 151 to 156 as the valve group 120. The fuel injection valves 121 to 126 open at different timings under a control of an electronic control unit (ECU: not shown) configured to control the injection timing. When the fuel injection valves 121 to 126 are opened, the fuel is injected into the first to sixth cylinders.

The fuel injection valve 121 is situated at the frontmost side among the fuel injection valves 121 to 126. The fuel injection valve 122 is situated behind the fuel injection valve 121. The fuel injection valve 123 is situated behind the fuel injection valve 122. The fuel injection valve 124 is situated behind the fuel injection valve 123. The fuel injection valve 125 is situated behind the fuel injection valve 124. The fuel injection valve 126 is situated at the rearmost side among the fuel injection valves 121 to 126.

The fuel injection valve 121 is connected to the fuel supply tube 151 extending from the connection portion 162. The fuel injection valve 122 is connected to the fuel supply tube 153 extending from the connection portion 164. The fuel injection valve 123 is connected to the fuel supply tube 152 extending from the connection portion 163 between the connection portions 162, 164 so as to intersect with the fuel supply tube 153 stereoscopically. The fuel injection valve 124 is connected to the fuel supply tube 155 extending from the connection portion 167. The fuel injection valve 125 is connected to the fuel supply tube 154 extending from the connection portion 166 in front of the connection portion 167 so as to intersect with the fuel supply tube 155 stereoscopically. The fuel injection valve 126 is connected to the fuel supply tube 156 extending from the connection portion 168 behind the connection portion 167.

The fuel pump portion 110 discharges an amount of fuel exceeding an injection amount of fuel from the fuel injection valves 121 to 126 so as to set a pressure of the fuel in the first and second distribution pipes 141, 142 to a high value. Accordingly, the fuel is injected vigorously from the fuel injection valves 121 to 126. Since an amount of fuel which exceeds an injection amount of the fuel is supplied from the fuel pump portion 110 to the first and second distribution pipes 141, 142, a pressure of the fuel in the first and second distribution pipes 141, 142 may exceed a predetermined threshold value. Accordingly, a pressure regulating mechanism for reducing a pressure in the first and second distribution pipes 141, 142 is mounted on the first and second distribution pipes 141, 142. The pressure regulating mechanism is described below.

The pressure regulating mechanism is configured to cause leakage of the fuel from the fuel distribution portion 140 such that a pressure of the fuel in the fuel distribution portion 140 is reduced, and guide the fuel leaked from the fuel distribution portion 140 downward. As portions for leaking the fuel from the fuel distribution portion 140 to cause a reduction in pressure of the fuel in the fuel distribution portion 140, the fuel supply device 100 includes: two pressure regulating valves 171, 172 provided in correspondence to the first and second distribution pipes 141, 142 respectively; and two leak portions 173, 174 protruding upward from the circumferential walls of the first and second distribution pipes 141, 142 respectively. As portions for guiding the fuel leaked from the fuel distribution portion 140 downward, the fuel supply device 100 includes two pressure regulating tubes 175, 176 extending from the leak portions 173, 174, and a connecting member 177 situated below the first and second distribution pipes 141, 142.

The pressure regulating valve 171 is mounted on the rear end of the main pipe 161 of the first distribution pipe 141. The pressure regulating valve 171 is a mechanical valve element configured to communicate an internal space of the first distribution pipe 141 with a flow path formed by the leak portion 173 protruding from the circumferential wall of the main pipe 161 of the first distribution pipe 141 behind the connection portion 164, and close the communication portion between the first distribution pipe 141 and the leak portion 173 in response to a pressure of the fuel in the first distribution pipe 141. Likewise, the pressure regulating valve 172 is a mechanical valve element configured to communicate an internal space of the second distribution pipe 142 with a flow path formed by the leak portion 174 protruding from the circumferential wall of the main pipe 165 of the second distribution pipe 142 behind the connection portion 168, and close the communication portion between the second distribution pipe 142 and the leak portion 174 in response to a pressure of the fuel in the second distribution pipe 142.

The fuel leaked from the leak portions 173, 174 flows into the pressure regulating tubes 175, 176. The pressure regulating tube 175 extends downward from the leak portion 173 and passes through the gap formed between the intake ports 233, 234. The lower end of the pressure regulating tube 175 is connected to the connection member 177. The pressure regulating tube 176 is connected to the leak portions 174, 173. The connection member 177 is connected to a tube member (not shown) which is connected to the fuel tank.

<Operation of Fuel Supply Device>

The operation of the fuel supply device 100 is described below.

When the fuel pump portion 110 is operated, the fuel in the fuel tank is sucked by the fuel pump portion 110 and reaches the fuel pump portion 110. The fuel pump portion 110 discharges the fuel from the discharge portions 113, 114. The fuel is guided to the first and second distribution pipes 141, 142 respectively by the guide tubes 131, 132 extending from the discharge portions 113, 114. Thereafter, the fuel is temporarily stored in the first and second distribution pipes 141, 142. The fuel pump portion 110 discharges an amount of the fuel larger than an amount of the fuel injected from the fuel injection valves 121 to 126 so that pressures of the fuel in the first and second distribution pipes 141, 142 are increased.

The high-pressure fuel in the first and second distribution pipes 141, 142 is injected into the six cylinders in the engine 200 when the fuel injection valves 121 to 126 are opened. The fuel injection valves 121 to 126 are opened at different timings under the control of the ECU. When the fuel injection valves 121, 122, 123 are opened, the fuel in the first distribution pipe 141 flows in the fuel injection valves 121, 122, 123 through the fuel supply tubes 151, 153, 152, and is injected from the fuel injection valves 121, 122, 123 into the first to third cylinders. When the fuel injection valves 124, 125, 126 are opened, the fuel in the second distribution pipe 142 flows in the fuel injection valves 124, 125, 126 through the fuel supply tubes 155, 154, 156, and is injected from the fuel injection valves 124, 125, 126 into the fourth to sixth cylinders.

When the pressure of the fuel in the first and second distribution pipes 141, 142 exceeds a predetermined threshold value, the pressure regulating valves 171, 172 are opened. When the pressure regulating valve 171 is opened, the fuel in the first distribution pipe 141 leaks out from the leak portion 173 and flows into the pressure regulating tube 175. When the pressure regulating valve 172 is opened, the fuel in the second distribution pipe 142 leaks out from the leak portion 174 and flows into the pressure regulating tube 176. The fuel which flows into the pressure regulating tube 176 passes through the pressure regulating tube 176 and the leak portion 173 sequentially, and flows into the pressure regulating tube 175. The fuel which flows into the pressure regulating tube 175 flows downward along the pressure regulating tube 175, and reaches the connection member 177 situated below the first and second distribution pipes 141, 142. Thereafter, the fuel flows from the connection member 177 into the tube member connected to the fuel tank, and returns to the fuel tank.

<Fuel Distribution Portion and Fuel Supply Tube>

Since the engine 200 has the six cylinders, the six fuel supply tubes 151 to 156 are used for supplying the fuel to these cylinders. The fuel supply tubes 151 to 156 and the fuel distribution portion 140 to which the fuel supply tubes 151 to 156 are connected are designed such that the fuel supply device 100 may be assembled efficiently. The structures of the fuel distribution portion 140 and the fuel supply tubes 151 to 156 are described below.

Figure 2:
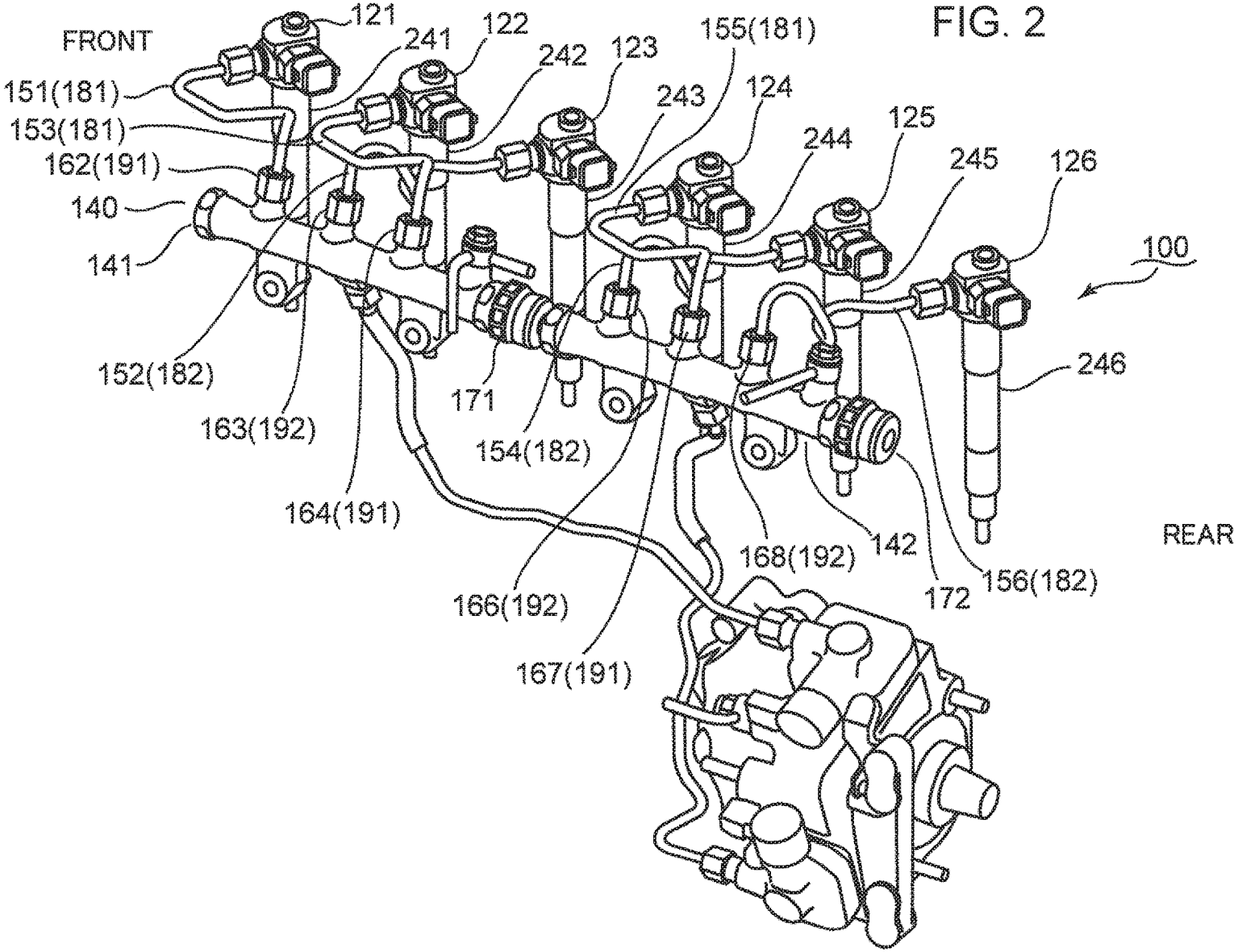
FIG. 2 is a schematic perspective view of the fuel supply device shown in FIG. 1.
Figure 3:
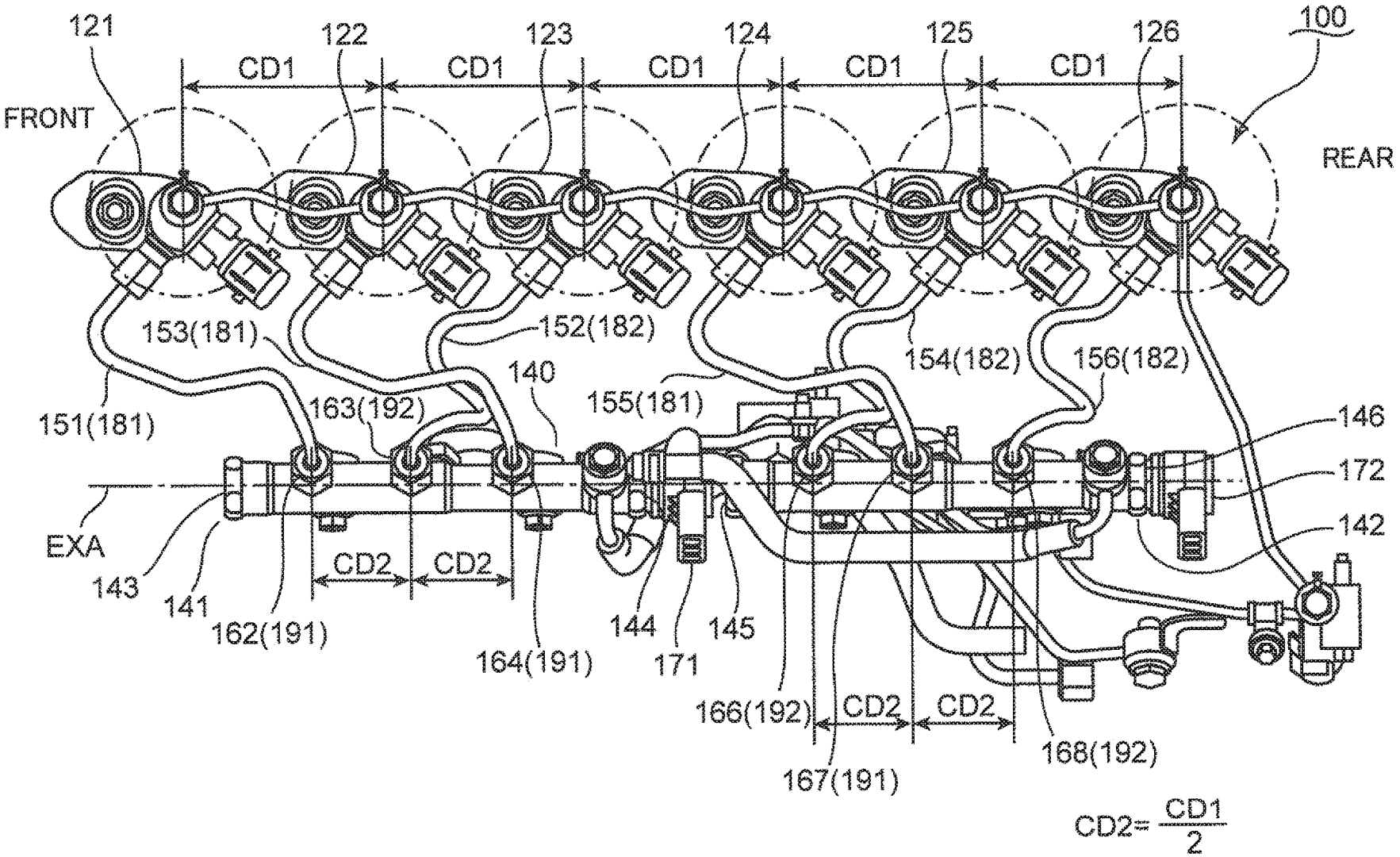
FIG. 3 is a schematic plan view of the fuel supply device shown in FIG. 1.

FIG. 2 is a schematic perspective view of the fuel supply device 100. FIG. 3 is a schematic plan view of the fuel supply device 100. The structure which contributes to efficiently assembling the fuel supply device 100 is described with reference to FIGS. 1 to 3.

FIG. 2 shows the first cylinder 241 to the sixth cylinder 246 formed in the cylinder block 211 (c.f. FIG. 1) in addition to the fuel supply device 100. The first cylinder 241 to the sixth cylinder 246 are arranged in the front-back direction at substantially regular intervals. The first cylinder 241 is situated at the front end of the cylinder row. The second cylinder 242 is situated adjacently to the first cylinder 241. The third cylinder 243 is situated adjacently to the second cylinder 242. The fourth cylinder 244 is situated adjacently to the third cylinder 243. The fifth cylinder 245 is situated adjacently to the fourth cylinder 244. The sixth cylinder 246 is situated adjacently to the fifth cylinder 245. In FIG. 3, a distance between the bore center axes (i.e. a distance between the bore center axes of the cylinders arranged adjacently to each other) is indicated by symbol "CD1".

The fuel injection valves 121 to 126 are mounted on the upper ends of the first cylinder 241 to the sixth cylinder 246, respectively. In short, the fuel injection valves 121 to 126 are arranged on the bore center axes of the first cylinder 241 to the sixth cylinder 246, respectively.

With respect to the connection portions 162, 164, 163 of the first distribution pipe 141 for distributing the fuel to the fuel injection valves 121, 122, 123, in FIG. 3, a distance between the center axes of the connection portions situated adjacently to each other is indicated by symbol "CD2". In short, the distance between the connection portions 162, 163 and the distance between the connection portions 163, 164 are "CD2", respectively. The distance between the center axes of the connection portions 166, 167, 168 behind the connection portions 162, 163, 164 is also set to "CD2". In short, the distance between the connection portions 166, 167 and the distance between the connection portions 167, 168 are also set to "CD2".

The distance "CD2" between the center axes is a value which is half of the distance "CD1" between the bore center axes (c.f. FIG. 3). Accordingly, the distance between the connection portions 162, 164 of the first distribution pipe 141 and the distance between the connection portions 166, 168 of the second distribution pipe 142 become "CD1", respectively. As described above, the connection portions 162, 164 are connected to the pair of fuel injection valves 121, 122 situated adjacently to each other by the fuel supply tubes 151, 153. The connection portions 166, 168 are connected to the pair of fuel injection valves 125, 126 situated adjacently to each other by the fuel supply tubes 154, 156. With regard to the present embodiment, the reference connection portion is exemplified by each of a pair of connection portions distant from each other by the distance "CD1" between the center axes. A middle connection portion is exemplified by the connection portion which is situated between the pair of connection portions distant from each other by the distance "CD1" between the center axes.

A distance between the connection portions 162, 164 is substantially equal to a distance between the fuel injection valves 121, 122 situated adjacently to each other, and the fuel injection valves 121 to 126 are arranged in a direction substantially in parallel to the arrangement direction of the connection portions 162 to 164, 166 to 168 of the fuel distribution portion 140 (i.e. an extending direction of the extension axis EXA). Accordingly, the relative positional relationship between the connection portion 162 and the fuel injection valve 121 becomes substantially equal to the relative positional relationship between the connection portion 164 and the fuel injection valve 122. Therefore, a designer may use first supply tubes 181 which have a common shape (i.e. substantially equal to each other in shape) as the fuel supply tubes 151, 153 extending between the connection portion 162 and the fuel injection valve 121 and between the connection portion 164 and the fuel injection valve 122, respectively. The connection portion to which the first supply tube 181 is connected is referred to as "first connection portion 191" in the following description. In short, each of the connection portions 162, 164 is the first connection portion 191.

Likewise, a distance between the connection portions 166, 168 is substantially equal to a distance between the fuel injection valves 125, 126 situated adjacently to each other, and the fuel injection valves 121 to 126 are situated in a direction substantially in parallel to the arrangement direction of the connection portions 162 to 164, 166 to 168 of the fuel distribution portion 140. Accordingly, the relative positional relationship between the connection portion 166 and the fuel injection valve 125 becomes substantially equal to the relative positional relationship between the connection portion 168 and the fuel injection valve 126. Therefore, a designer may use second supply tubes 182 which have a common shape (i.e. substantially equal to each other in shape) as the fuel supply tubes 154, 156 extending between the connection portion 166 and the fuel injection valve 125 and between the connection portion 168 and the fuel injection valve 126, respectively. The second supply tubes 182 have a second shape designed so as to extend obliquely rearward from the connection portions 166, 168 with respect to an imaginary plane orthogonal to the extension axis EXA whereas the first supply tubes 181 have a first shape designed so as to extend obliquely frontward from the connection portions 162, 164 with respect to the imaginary plane orthogonal to the extension axis EXA. In short, the second supply tubes 182 are different in shape from the first supply tubes 181. The connection portion to which the second supply tube 182 is connected is referred to as "second connection portion 192" in the following description. In short, each of the connection portions 166, 168 is the second connection portion 192. Since the two second connection portions 192 are mounted on the second distribution pipe 142, an operator may connect two second supply tubes 182 to the second distribution pipe 142. Likewise, since the two first connection portions 191 are mounted on the first distribution pipe 141, the operator may connect the two first supply tubes 181 to the first distribution pipe 141.

The connection portion 163 between the connection portions 162, 164 to which the two first supply tubes 181 are connected is distant from the connection portions 162, 164 by the distance "CD2", respectively. The distance between the connection portion 163 and each of the connection portions 162, 164 is not coincident with a distance between the fuel injection valve 123 connected to the connection portion 163 by the fuel supply tube 152 and the fuel injection valve 122 situated in front of the fuel injection valve 123 (=CD1>CD2). Accordingly, the relative positional relationship between the connection portion 163 and the fuel injection valve 123 is not coincident with the relative positional relationship between the connection portion 164 (or the connection portion 162) and the fuel injection valve 122 (or the fuel injection valve 121). In short, the distance from the connection portion 163 to the fuel injection valve 123 is not substantially equal to the distance from the connection portion 164 to the fuel injection valve 122. On the other hand, the second distribution pipe 142 is arranged such that the distance from the connection portion 166 of the second distribution pipe 142 to the fuel injection valve 125 becomes substantially equal to the distance from the connection portion 163 of the first distribution pipe 141 to the fuel injection valve 123. Accordingly, the relative positional relationship between the connection portion 163 and the fuel injection valve 123 is substantially coincident with the relative positional relationship between the connection portion 166 and the fuel injection valve 125. Therefore, the fuel supply tube 152 connected to the connection portion 163 and the fuel injection valve 123 may have the common shape with the fuel supply tube 154 connected to the connection portion 166 and the fuel injection valve 125. In short, the designer may use the second supply tube 182 as the fuel supply tube 152. Accordingly, the connection portion 163 connected to the fuel supply tube 152 becomes the second connection portion 192. With regard to the present embodiment, the second reference connection portion is exemplified by the second connection portions having the positional relationship in which the second connection portions are distant from each other by the distance "CD1" between the center axes.

A distance between the connection portion 163 to which the fuel supply tube 152 is connected and the connection portion 164 situated behind the connection portion 163 is substantially coincident with a distance between the connection portion 166 of the second distribution pipe 142 and the connection portion 167 situated behind the connection portion 166. In addition, a distance between the fuel injection valve 123 in correspondence to the connection portion 163 and the fuel injection valve 122 situated in front of the fuel injection valve 123 is substantially coincident with a distance between the fuel injection valve 125 in correspondence to the connection portion 166 and the fuel injection valve 124 situated in front of the fuel injection valve 125. Accordingly, the positional relationship between the connection portion 167 of the second distribution pipe 142 and the fuel injection valve 124 becomes substantially equal to the positional relationship between the connection portion 164 of the first distribution pipe 141 and the fuel injection valve 122. Therefore, the fuel supply tube 155 connected to the connection portion 167 and the fuel injection valve 124 may have a common shape with the fuel supply tube 153 connected to the connection portion 164 and the fuel injection valve 122. In short, a designer may use the first supply tube 181 as the fuel supply tube 155. Accordingly, the connection portion 167 connected to the fuel supply tube 155 becomes the first connection portion 191. With regard to the present embodiment, the first reference connection portions are exemplified by the first connection portions having the positional relationship in which the first connection portions are distant from each other by the distance "CD1" between the center axes.

Two first supply tubes 181 and one second supply tube 182 are connected to the first distribution pipe 141 whereas one first supply tube 181 and two second supply tubes 182 are connected to the second distribution pipe 142. As described above, the first and second distribution pipes 141, 142 have common shapes (i.e. the first and second distribution pipes 141, 142 are prepared on the basis of common drawings). The structures of the first and second distribution pipes 141, 142 are described below.

As shown in FIG. 3, the first distribution pipe 141 includes a proximal end 143 and a distal end 144 opposite to the proximal end 143. The proximal end 143 forms the front end of the first distribution pipe 141. The distal end 144 forms the rear end of the first distribution pipe 141, the distal end 144 being closer to the second distribution pipe 142 than the proximal end 143. Like the first distribution pipe 141, the second distribution pipe 142 includes a proximal end 145 and a distal end 146 opposite to the proximal end 145. The proximal end 145 of the second distribution pipe 142 is adjacent to the distal end 144 of the first distribution pipe 141. The pressure regulating valve 171 configured to regulate a pressure of fuel in the first distribution pipe 141 is situated between the distal end 144 of the first distribution pipe 141 and the proximal end 145 of the second distribution pipe 142. The distal end 146 of the second distribution pipe 142 is more distant from the distal end 144 of the first distribution pipe 141 than the proximal end 145 of the second distribution pipe 142. The distal end 146 forms the rear end of the second distribution pipe 142. The pressure regulating valve 172 configured to regulate a pressure of fuel in the second distribution pipe 142 is mounted on the distal end 146 of the second distribution pipe 142.

The second distribution pipe 142 is designed such that the second distribution pipe 142 is substantially as long as the first distribution pipe 141. In addition, the positions of the connection portions 166, 167, 168 are determined such that the distances from the proximal end 145 of the second distribution pipe 142 to the three connection portions 166, 167, 168 of the second distribution pipe 142 become substantially coincident with the distances from the proximal end 143 of the first distribution pipe 141 to the three connection portions 162, 163, 164 of the first distribution pipe 141. The distance from the proximal end 145 of the second distribution pipe 142 to the distal end 144 of the first distribution pipe 141 is set such that the distance from the connection portion 166 of the second distribution pipe 142 to the fuel injection valve 125 becomes substantially coincident with the distance from the connection portion 163 of the first distribution pipe 141 to the fuel injection valve 123.

<Efficiency in Assembling Fuel Supply Device>

The fuel supply device 100 in the context of the first embodiment enables an efficiently assembling operation of the fuel supply device 100. It is described below how the fuel supply device 100 is efficiently assembled.

The connection portions 162, 164 of the first distribution pipe 141 are the first connection portions 191 to which the first supply tubes 181 are connected. Accordingly, the fuel supply paths to two fuel injection valves 121, 122 are formed by using the fuel supply tubes of one type. Likewise, each of the connection portions 166, 168 of the second distribution pipe 142 is the second connection portion 192 to which the second supply tube 182 is connected. Therefore, the fuel supply path to the two fuel injection valves 125, 126 are formed by one type of fuel supply tubes. In addition, the connection portion 163 between the connection portions 162, 164 of the first distribution pipe 141 is the second connection portion 192 to which the second supply tube 182 is connected. On the other hand, the connection portion 167 between the connection portions 166, 168 of the second distribution pipe 142 is the first connection portion 191 to which the first supply tube 181 is connected. Accordingly, the fuel supply paths to the six fuel injection valves 121 to 126 are formed by fuel supply tubes of only two kinds such as the first and second supply tubes 181, 182. It is unnecessary for an operator to find out suitable fuel supply tubes from a group formed of a large kinds of fuel supply tubes. Accordingly, the operator may quickly select appropriate fuel supply tubes from two kinds of fuel supply tubes. In addition, a risk of the operator erroneously assembling a wrong fuel supply tube into the fuel supply device 100 may be largely reduced. Accordingly, the fuel supply device 100 may be assembled efficiently.

The inclination direction of the second supply tubes 182 is opposite to the inclination direction of the first supply tubes 181. In short, the first supply tubes 181 are connected to the first connection portions 191 formed at positions which are off rearward from the respective fuel injection valves 121, 122, 124 and the respective fuel injection valves 121, 122, 124 along the extension axis EXA. On the other hand, the second supply tubes 182 are connected to the second connection portions 192 formed at positions which are off frontward from the respective fuel injection valves 123, 125, 126 and the respective fuel injection valves 123, 125, 126 along the extension axis EXA. Accordingly, the operator may visually and immediately determine whether a selected fuel supply tube is the first or second supply tube 181, 182. In short, it takes a short time for the operator to select an appropriate fuel supply tube.

Since the inclination direction of the second supply tubes 182 is opposite to the inclination direction of the first supply tubes 181, some of fuel supply paths from the fuel distribution portions to the fuel injection valves 121 intersect with each other. However, since the second supply tubes 182 are formed so as to stereoscopically intersect with the first supply tubes 181, the operator may assemble the second supply tubes 182 into the fuel supply device 100 without causing an interference between the second and first supply tubes 182, 181.

When fuel supply paths to the six fuel injection valves 121 to 126 are formed of the fuel supply tubes of one kind, the assembling efficiency of the fuel supply device is further enhanced. However, there may be severe restrictions for designing the fuel distribution portion of the fuel supply device. On the other hand, two kinds of fuel supply tubes such as the first and second supply tubes 181, 182 are assembled in the fuel supply device 100 of the present embodiment. Accordingly, a designer may form the fuel distribution portion 140 using the first distribution pipe 141 and the second distribution pipe 142 which is distant from the first distribution pipe 141. The first distribution pipe 141 has the common shape with the second distribution pipe 142 so that an operator does not have to select an appropriate distribution pipe from a plurarity of distribution pipes whereby the operator may efficiently prepare the fuel distribution portion 140.

The second connection portion 192 of the first distribution pipe 141 is arranged between the pair of first connection portions 191. The row of the three fuel injection valves 121, 122, 123 which receive the supply of fuel from the first distribution pipe 141 is twice as long as the distance between the bore center axes. On the other hand, the row of the pair of first connection portions 191 and the second connection portion 192 which correspond to the fuel injection valves 121, 123, 122 is as long as the distance between the bore center axes. Accordingly, the first distribution pipe 141 does not become excessively long. Likewise, the first connection portion 191 of the second distribution pipe 142 to which one of the three first supply tubes 181 is connected is arranged between the pair of second connection portions 192. The row of the three fuel injection valves 124, 125, 126 which receive the supply of fuel from the second distribution pipe 142 is twice as long as the distance between the bore center axes. On the other hand, the row of the pair of second connection portions 192 and the first connection portion 191 which correspond to the fuel injection valves 125, 126, 124 is as long as the distance between the bore center axes. Accordingly, the second distribution pipe 142 does not also become excessively long. Since the fuel distribution portion 140 does not become excessively long, it is possible to acquire a space which allows a designer to arrange the pressure regulating valves 171, 172 at the end portions of the first and second distribution pipes 141, 142.

The second connection portion 192 of the first distribution pipe 141 is arranged at the middle position between the pair of first connection portions. Likewise, the first connection portion 191 of the second distribution pipe 142 is arranged at the middle position between the pair of second connection portions. Accordingly, the distance between the first and second connection portions 191, 192 of the first distribution pipe 141 becomes substantially as long as the distance between the first and second connection portions 191, 192 of the second distribution pipe 142. Therefore, a designer may determine arrangement positions of the first and second distribution pipes 141, 142 so that the relative positional relationship among the fuel injection valves 122, 123, the second connection portion 192 of the first distribution pipe 141 and the first distribution pipe 141 corresponding to the fuel injection valve 123 becomes substantially equal to the relative positional relationship among the fuel injection valves 124, 125, the second connection portion 192 of the second distribution pipe 142 corresponding to the fuel injection valve 124 and the first connection portion 191 of the second distribution pipe 142.

Second Embodiment

The fuel distribution portion 140 of the fuel supply device 100 according to the first embodiment includes the first distribution pipe 141 and the second distribution pipe 142 arranged at a position which is distant from the first distribution pipe 141. However, the fuel distribution portion may be formed of a single pipe member. A fuel supply device having a fuel distribution portion formed of a single pipe member is described in the second embodiment.

Figure 4:
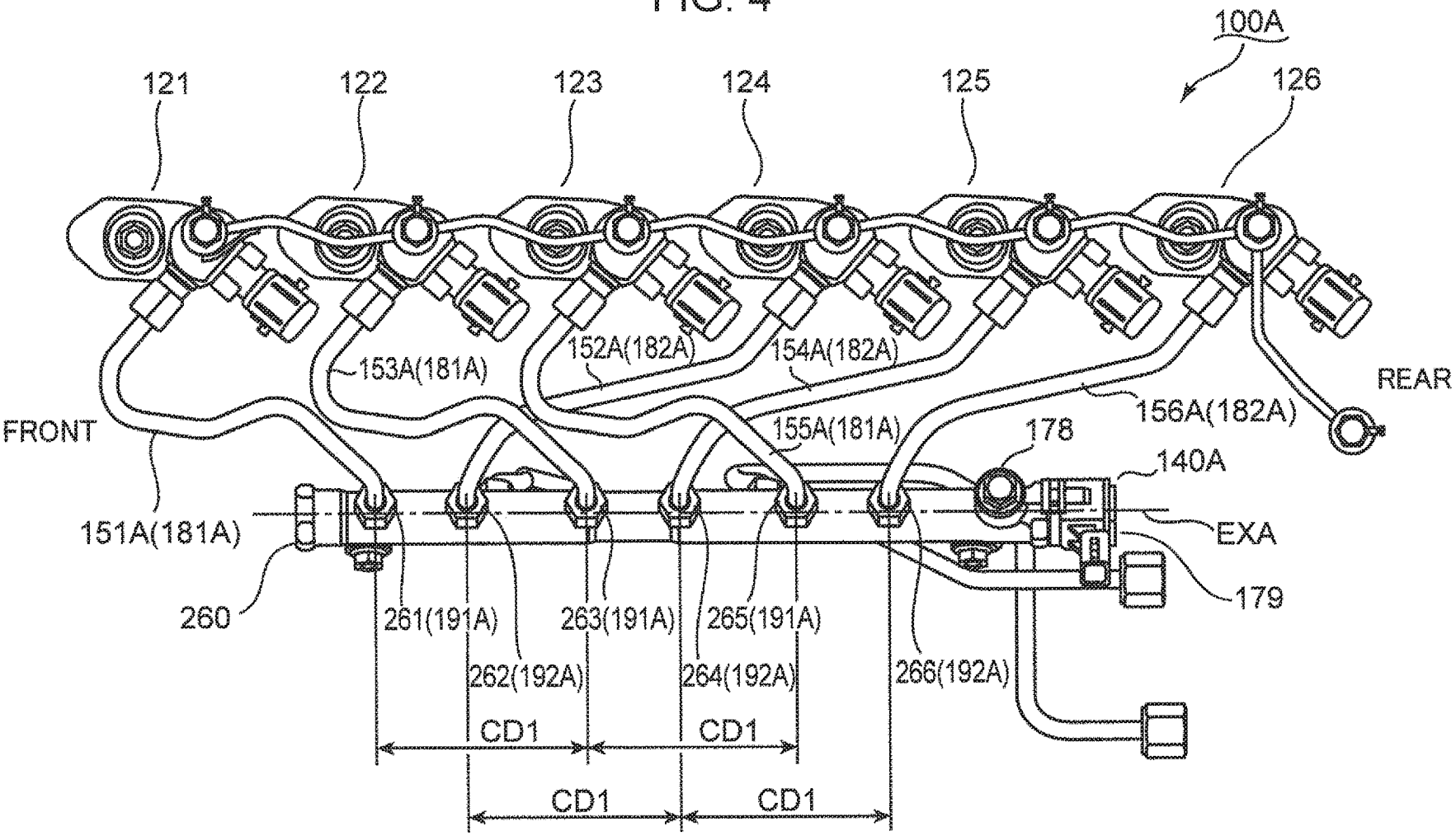
FIG. 4 is a schematic plan view of a fuel supply device according to the second embodiment.

FIG. 4 is a schematic plan view of the fuel supply device 100A according to the second embodiment. A structure of the fuel supply device 100A is described with reference to FIGS. 2 and 4.

FIG. 4 shows fuel injection valves 121 to 126, the fuel distribution portion 140A, fuel supply tubes 151A to 156A, a leak portion 178, and a pressure regulating valve 179 as parts of the fuel supply device 100A. The description of the first embodiment is applicable to the fuel injection valves 121 to 126. The fuel distribution portion 140A receives the supply of fuel from a fuel pump (not shown). The description of the first embodiment is applicable to the supply of fuel from the fuel pump to the fuel distribution portion 140A. The fuel supplied from the fuel pump is temporarily stored in the fuel distribution portion 140A. Fuel supply paths from the fuel distribution portion 140A to the fuel injection valves 121 to 126 are formed by the fuel supply tubes 151A to 156A. When a pressure of fuel in the fuel distribution portion 140A exceeds a predetermined threshold value, the pressure regulating valve 179 is operated, so that the fuel in the fuel distribution portion 140A leaks from the leak portion 178. A pipe member connected to a fuel tank (not shown) is connected to the leak portion 178, so that the fuel leaked from the leak portion 178 may return to the fuel tank.

The fuel distribution portion 140A of the second embodiment is formed as a single pipe member unlike the fuel distribution portion 140 of the first embodiment. The fuel distribution portion 140A includes a main pipe 260 and connection portions 261 to 266 protruding upward from the main pipe 260. Unlike the first embodiment, the main pipe 260 is a single pipe member. The main pipe 260 extends in the front-back direction along the extension axis EXA. The fuel supply tubes 151A to 156A are connected to the connection portions 261 to 266 aligned along the extension axis EXA on the main pipe 260 respectively.

The connection portion 261 is arranged at the frontmost side among the connection portions 261 to 266. The connection portion 262 is arranged behind the connection portion 261. The connection portion 263 is arranged behind the connection portion 262. The connection portion 264 is arranged behind the connection portion 263. The connection portion 265 is arranged behind the connection portion 264. The connection portion 266 is arranged at the rearmost side among the connection portions 261 to 266.

A distance between the connection portions 261, 263, and a distance between the connection portions 263, 265 are substantially coincident with the distance "CD1" between bore center axes. Fuel which flows out from the fuel distribution portion 140A through the connection portions 261, 263, 265 is supplied to the fuel injection valves 121, 122, 123 connected to the first to third cylinders 241, 242, 243 (c.f. FIG. 2) through the fuel supply tubes 151A, 153A, 155A. The fuel supply tubes 151A, 153A, 155A have a common shape, so that the first supply tubes 181A are used as the fuel supply tubes 151A, 153A, 155A. The connection portions 261, 263, 265 to which the first supply tubes 181A are connected respectively are referred to as "first connection portions 191A" in the following description.

The remaining connection portions 262, 264, 266 are referred to as "second connection portions 192A" in the following description. The fuel supply tubes 152A, 154A, 156A are connected to these second connection portions 192A, the fuel supply tubes 152A, 154A, 156A being formed by using the second supply tubes 182A which are different in shape from the first supply tubes 181A.

A distance between the connection portions 262, 264 and a distance between the connection portions 264, 266 are substantially coincident with the distance "CD1" between the bore center axes. Each of the connection portions 262, 264 is the second connection portion 192A arranged between the pair of first connection portions 191A. Unlike the first embodiment, each of these second connection portions 192A is not arranged at the middle position between the pair of first connection portions 191A. The positions of the second connection portions 192A are determined on the basis of the positions of the fuel injection valves 122, 124, 126 and the shape of the second supply tubes 182A.

The connection portion 263 between the connection portions 262, 264, and the connection portion 265 between the connection portions 264, 266 are the first connection portion 191A arranged between the pair of second connection portions 192A respectively. Unlike the first embodiment, each of these first connection portions 191A is not arranged at the middle position between the pair of second connection portions 192A. The positions of the first connection portions 191A are determined on the basis of the positions of the fuel injection valves 121, 123, 125 and the shape of the first supply tubes 181A.

Each of the first supply tubes 181A has the first shape inclined frontward from the first connection portion 191A. Unlike the first supply tubes 181A, each of the second supply tubes 182A has the second shape inclined rearward from the second connection portion 192A. Accordingly, some of the fuel supply paths from the fuel distribution portion 140A to the fuel injection valves 121 to 126 intersect with each other. Accordingly, the first supply tubes 181A are formed so as to stereoscopically intersect with the second supply tubes 182A.

Fuel is supplied to the fuel injection valves 121 to 126 through the first and second supply tubes 181A, 182A. The fuel is injected from the fuel injection valves 121 to 126 to the first to sixth cylinders 241 to 246 respectively. Since an amount of fuel larger than an amount of fuel injected from the fuel injection valves 121 to 126 to the first to sixth cylinders 241 to 246 is supplied from the fuel pump to the fuel distribution portion 140A, there is an increase in a pressure of the fuel in the fuel distribution portion 140A. When a pressure of fuel in the fuel distribution portion 140A exceeds a predetermined threshold value, the pressure regulating valve 179 mounted on the rear end of the main pipe 260 is operated to cause a communication of the main pipe 260 with the leak portion 178 which protrudes upward from the circumferential wall of the main pipe 260 behind the connection portion 266. Accordingly, the fuel in the main pipe 260 flows out from the leak portion 178 and is guided to the fuel tank through the pipe member connected to the leak portion 178.

Only two kinds of supply tubes such as the first and second supply tubes 181A, 182A are used for forming the fuel supply paths from the fuel distribution portion 140A to the fuel injection valves 121 to 126. Accordingly, like the fuel supply device 100 of the first embodiment, the fuel supply device 100A of the second embodiment may be efficiently assembled.

The three first connection portions 191A to which the first supply tubes 181A are connected respectively and the three second connection portions 192A to which the second supply tubes 182A are connected respectively are alternately arranged. Accordingly, a distance between the first and second connection portions 191A, 192A which are adjacent to each other becomes shorter than a distance between the fuel injection valves which are adjacent to each other. Accordingly, a row of the first and second connection portions 191A, 192A of the fuel distribution portion 140A becomes shorter than a row of the fuel injection valves 121 to 126. Therefore, the fuel distribution portion 140A does not become excessively long.

In conformity with the alternate arrangement of the three first connection portions 191A and the three second connection portions 192A, the first supply tubes 181A are formed such that the inclination direction of the first supply tubes 181A becomes opposite to the inclination direction of the second supply tubes 182A. Accordingly, an operator may visually and immediately find out whether a selected fuel supply tube is the first or second supply tube 181A, 182A. Therefore, it takes a short time for the operator to select an appropriate fuel supply tubes.

The inclination direction of the first supply tubes 181A is opposite to the inclination direction of the second supply tubes 182A, so that some of the fuel supply paths from the fuel distribution portion 140A to the fuel injection valves 121 to 126 intersect with each other. The first supply tubes 181A are formed so as to stereoscopically intersect with the second supply tubes 182A, so that an operator may assemble the first supply tubes 181A into the fuel supply device 100A without an interference between the first and second supply tubes 181A, 182A.

With regard to the aforementioned embodiments, the engine 200 includes the six cylinders, so that the fuel supply devices 100, 100A are formed so as to inject fuel into six cylinders. Alternatively, the fuel supply device may be formed so as to inject fuel into less or more than six cylinders.

With regard to the aforementioned embodiments, two kinds of fuel supply tubes such as the first supply tubes 181, 181A and the second supply tubes 182, 182A are used for supplying fuel to the six fuel injection valves 121 to 126. Alternatively, two of six fuel supply tubes forming the fuel supply paths to the six fuel injection valves 121 to 126 have a common shape whereas the remaining four fuel supply tubes may have different shapes from each other. Or, six fuel supply tubes which form fuel supply paths to the six fuel injection valves 121 to 126 may have a common shape.

With regard to the aforementioned embodiments, the structure for supplying fuel to the fuel distribution portions 140, 140A has been described in detail. However, a designer may design various structures for supplying fuel to the fuel distribution portions 140, 140A. Accordingly, the principles of the aforementioned embodiments are not limited at all by the structures for supplying fuel to the fuel distribution portions 140, 140A.

With regard to the aforementioned embodiments, the pressure regulating mechanism for regulating a pressure of fuel in the fuel distribution portions 140, 140A has been described in detail. However, a designer may design various structures for the pressure regulating mechanism. Accordingly, the principles of the aforementioned embodiments are not limited at all by the pressure regulating mechanism.

The exemplary fuel supply devices described in the context of the aforementioned embodiments mainly have the following features.

The fuel supply device according to one aspect of the aforementioned embodiment is configured to supply fuel to an engine having cylinders arranged at regular intervals in a predetermined arrangement direction. The fuel supply device includes: fuel injection valves respectively arranged on center axes of the cylinders, the fuel injection valves being configured to inject the fuel into the cylinders; a fuel distribution portion configured to distribute the fuel to the fuel injection valves; and fuel supply tubes configured to form supply paths for the fuel from the fuel distribution portion to the fuel injection valves. The fuel distribution portion includes connection portions arranged in the arrangement direction so as to be connected to the fuel supply tubes. The connection portions include a pair of reference connection portions situated at positions distant from each other in the arrangement direction by a distance between respective bore center axes of the cylinders. The fuel supply tubes include a pair of fuel supply tubes respectively connected to the pair of reference connection portions and two fuel injection valves on two cylinders arranged adjacently to each other. The pair of fuel supply tubes have a common shape.

According to the aforementioned configuration, the pair of fuel supply tubes have common shapes, the fuel injections valves being connected to the fuel injections valves, which are respectively arranged at two adjacent cylinders, and the pair of reference connection portions situated at positions which are distant in the arrangement direction from each other by the distance between the bore center axes. Accordingly, these fuel supply tubes may be connected to any one of the pair of reference connection portions. Since kinds of fuel supply tubes become less than the cylinders, it takes a short time for an operator to select fuel supply tubes having appropriate shapes. In addition, a risk of an operator erroneously mounting a wrong-shaped fuel supply tubes on the fuel supply device may be reduced. Accordingly, the assembling operation of the fuel supply device may be performed more efficiently.

The pair of fuel supply tubes which has common shapes are incorporated in the fuel supply device, so that a distance between the pair of connection portions is set to a distance between the bore center axes, and the arrangement direction of the pair of connection portions is substantially coincident with the arrangement direction of the cylinders. The distance between the pair of connection portions set to the distance between the bore center axes is substantially coincident with the distance between two adjacent fuel injection valves situated on the center axes of the cylinders respectively. The arrangement direction of the pair of connection portions is substantially coincident with the arrangement direction of the cylinders, so that the arrangement direction of the pair of connection portions is also substantially coincident with the arrangement direction of two adjacent fuel injection valves situated on the center axes of the cylinders respectively. The arrangement distance and the arrangement direction of the pair of connection portions are substantially coincident with the arrangement distance and the arrangement direction of two fuel injection valves. Accordingly, a line segment which connects one of the pair of connection portions to one of two fuel injection valves has a parallel relationship with a line segment which connects the other of the pair of connection portions to the other of the pair of fuel injection valves, and lengths of these line segments are substantially coincident with each other. Accordingly, when one of the pair of fuel supply tubes is formed so as to be connected to one of the pair of connection portions and one of two fuel injection valves, an operator may connect the other fuel supply tube having the common shape to the other of the pair of connection portions and the other of two fuel injection valves.

With respect to the aforementioned configuration, the connection portions may include a middle connection portion situated between the pair of reference connection portions. One of the fuel supply tubes extends from the middle connection portion between the pair of reference connection portions so as to stereoscopically intersect with the fuel supply tube connected to one of the two fuel injection valves, the one of the fuel supply tubes being connected to the fuel injection valve arranged adjacently to the one of the two fuel injection valves.

If positions of all of the connection portions are determined such that the connection portions are distant from each other by a distance between the bore center axes, a row of the connection portions becomes as long as a row of the cylinders. Accordingly, the fuel distribution portion having the connection portions becomes excessively long in the arrangement direction of the cylinders (i.e. the fuel distribution portion becoming longer than a length obtained from a formula of center-to-center distance x (number of cylinders-1)). According to the aforementioned configuration, the connection portions include one middle connection portion situated between the pair of reference connection portions, so that distances between the pair of reference connection portions and one middle connection portion situated between the pair of reference connection portions become shorter than the distance between the bore center axes.

The fuel supply tube connected to one middle connection portion between the pair of reference connection portions and to the fuel injection valve, which is adjacent to one of two fuel injection valves, stereoscopically intersects with the fuel supply tube which is connected to one of the pair of fuel injection valves. Accordingly, an operator may connect these fuel supply tubes to the corresponding fuel injection valves and the corresponding connection portions without an interference between these fuel supply tubes.

With respect to the aforementioned configuration, the fuel supply tubes may include first supply tubes each of which has a first shape formed so as to connect a fuel injection valve and a connection portion, which are distant from each other by a predetermined first distance, and second supply tubes each of which has a second shape formed so as to connect a fuel injection valve and a connection portion, which are distant from each other by a second distance different from the first distance. The connection portions may include first connection portions to which the first supply tubes are connected, and second connection portions to which the second supply tubes are connected. The first connection portions may include a pair of first reference connection portions distant from each other in the arrangement direction by the distance between the bore center axes. The second connection portions may include a pair of second reference connection portions distant from each other in the arrangement direction by the distance between the bore center axes.

When there is only one kind of the fuel supply tubes incorporated in the fuel supply device, a distance between the fuel supply tubes and the connection portions has to be constant. In this case, there may be severe designing restrictions for the fuel distribution portion. According to the aforementioned configuration, the fuel supply tubes include the first supply tubes and the second supply tubes, each of the first supply tube having the first shape formed so as to allow each first supply tube to connect the fuel injection valve and the connection portion which is distant from the fuel injection valve by a predetermined first distance, each of the second supply tubes having the second shape formed so as to allow each second supply tube to connect the fuel injection valve and the connection portion which is distant from the fuel injection valve by a second distance different from the first distance. Accordingly, two values may be set for the distance between the fuel supply tubes and the connection portions. Therefore, there is a decrease in designing restrictions for the distribution pipe.

The pair of first reference connection portions is arranged at positions which are off from each other in the arrangement direction by the distance between the bore center axes. Accordingly, when the first supply tube extends from one of the pair of first reference connection portions is connected to one of the fuel injection valves, an operator may connect the first supply tube extending from the other of the pair of first reference connection portions to the fuel injection valve adjacent to one of the pair of fuel injection valves. Likewise, the pair of second reference connection portions is arranged at positions which are off from each other by the distance between the bore center axes in the arrangement direction. Accordingly, when the second supply tube extending from one of the pair of second reference connection portions is connected to one of the fuel injection valves, the operator may connect the second supply tube extending from the other of the pair of second reference connection portions to the fuel injection valve adjacent to one of the fuel injection valves. Accordingly, kinds of the fuel supply tubes half as many as the fuel supply paths are enough to form the fuel supply paths for these four fuel injection valves. Therefore, it takes a short time for an operator to select the fuel supply tubes having appropriate shapes. In addition, there may be a low risk of an operator erroneously mounting a wrong-shaped fuel supply tubes on the fuel supply device. Accordingly, the assembling operation of the fuel supply device may be performed efficiently.

With respect to the aforementioned configuration, the fuel distribution portion may extend along an extension axis which extends in the arrangement direction. Each of the first supply tubes may be connected to a corresponding fuel injection valve and a first connection portion which is situated at a position that is off from the fuel injection valve in a first direction along the extension axis. Each of the second supply tubes may be connected to a corresponding fuel injection valve and a second connection portion which is situated at a position that is off from the fuel injection valve in a second direction opposite to the first direction along the extension axis.

According to the aforementioned configuration, each of the second supply tubes is connected to a corresponding fuel injection valve and the second connection portion arranged at a position which is off from the fuel injection valve in the second direction opposite to the aforementioned first direction along the extension axis. Accordingly, a stereoscopic intersecting structure of the first and second supply tubes is formed. Since the first and second supply tubes form the stereoscopic intersecting structure, the inclination direction of the first supply tube is different from the inclination direction of the second supply tube. An operator may identify the difference between the first and second supply tubes on the basis of the difference in the inclination direction.

With respect to the aforementioned configuration, the fuel distribution portion may include a first distribution pipe which has the pair of first reference connection portions, and a second distribution pipe which is arranged at an interval from the first distribution pipe and has the pair of second reference connection portions, the first and second distribution pipes being arranged in series. One of the second connection portions may be situated at a middle position between the pair of first reference connection portions of the first distribution pipe. One of the first connection portions may be situated at a middle position between the pair of second reference connection portions of the second distribution pipe. A distance between the first and second distribution pipes may be set such that the second connection portion of the first distribution pipe is distant from one of the fuel injection valves by the second distance, and the first connection portion of the second distribution pipe is distant from another of the fuel injection valves by the first distance.

According to the aforementioned configuration, the fuel supply tubes include two kinds of supply tubes such as the first and second supply tubes which are different in shape from each other. Accordingly, there is a decrease in designing restrictions for the fuel distribution portion as described above. The fuel distribution portion may include the first distribution pipe and the second distribution pipe which is distant from the first distribution pipe, the second distribution pipe being arranged in series with respect to the first distribution pipe. Since the second distribution pipe is distant from the first distribution pipe, a transmission of pulsation is less likely to happen between the first and second distribution pipes. Since the second distribution pipe is arranged in series with the first distribution pipe, a distance between the row of the connection portions and the row of the fuel injection valves does not change between the first and second distribution pipes.

The second connection portion of the first distribution pipe is arranged at the middle position between the pair of first reference connection portions which are distant from each other by the distance between bore center axes. Likewise, the first connection portion of the second distribution pipe is arranged at the middle position between the pair of second reference connection portions which are distant from each other by the distance between the bore center axes. The relative positional relationship between the pair of first reference connection portions and the second connection portion of the first distribution pipe becomes substantially equal to a relative positional relationship between the pair of second reference connection portions and the first connection portion of the second distribution pipe. Accordingly, a designer may determine arrangement positions of the first and second distribution pipes such that the relative positional relationship between three connection portions of the first distribution pipe and the corresponding three fuel injection valves becomes substantially equal to the relative positional relationship between three connection portions of the second distribution pipe and the corresponding three fuel injection valves. The arrangement positions of the first and second distribution pipes are set such that the second connection portion of the first distribution pipe is distant from one of the fuel injection valves by the second distance, and the first connection portion of the second distribution pipe is distant from the other one of the fuel injection valves by the first distance. Accordingly, an operator may connect the second supply tube to the second connection portion of the first distribution pipe and one of the fuel injection valves. Likewise, the operator may connect the first supply tube to the first connection portion of the second distribution pipe and one of the fuel injection valves.

Since the second connection portion of the first distribution pipe may be arranged at the middle position between the pair of first reference connection portions, the second connection portion is distant from the first connection portion adjacent to the second connection portion by a distance which is half of the distance between the bore center axes. As described above, since the second supply tube is connected to the second connection portion of the first distribution pipe, a distance between the second connection portion of the first distribution pipe and one of the fuel injection valves is the second distance. Likewise, since the first connection portion of the second distribution pipe is arranged at the middle position between the pair of second connection portions, the first connection portion is distant from the second connection portion adjacent to the first connection portion by a distance which is half of the distance between the bore center axes. Accordingly, the relative positional relationship between the second connection portion of the first distribution pipe and a corresponding fuel injection valve becomes substantially equal to the relative positional relationship between the second connection portion of the second distribution pipe and a corresponding fuel injection valve. Since the second supply tube is used for the connection between the second connection portion of the first distribution pipe and the corresponding fuel injection valve, an operator may use the second supply tube also for the connection between the second connection portion of the second distribution pipe and the corresponding fuel injection valve.

Likewise, the relative positional relationship between the first connection portion of the second distribution pipe and the corresponding fuel injection valve becomes substantially equal to the relative positional relationship between the first connection portion of the first distribution pipe and the corresponding fuel injection valve. Since the first supply tube is used for the connection between the first connection portion of the second distribution pipe and the corresponding fuel injection valve, an operator may use the first supply tube also for the connection between the first connection portion of the first distribution pipe and the corresponding fuel injection valve.

With respect to the aforementioned configuration, the second distribution pipe may have a shape in common with the first distribution pipe.

According to the aforementioned configuration, since the second distribution pipe has a common shape with the first distribution pipe, it is sufficient that one type of pipe member is prepared as the first and second distribution pipes.

With respect to the aforementioned configuration, the engine may be formed of an in-line six-cylinder engine having six cylinders consisting of a first cylinder to a sixth cylinder as the cylinders. The fuel injection valves may be formed of six fuel injection valves mounted on the first cylinder, the second cylinder, the third cylinder, the fourth cylinder, the fifth cylinder and the sixth cylinder, respectively. The fuel may be distributed to the three fuel injection valves mounted on the first cylinder, the second cylinder and the third cylinder through the first distribution pipe. The fuel may be distributed to the three fuel injection valves mounted on the fourth cylinder, the fifth cylinder and the sixth cylinder through the second distribution pipe. A pair of first supply tubes extending from the pair of first reference connection portions of the first distribution pipe may be connected to the pair of fuel injection valves mounted on the first and second cylinders, respectively. A second supply tube extending from the second connection portion of the first distribution pipe may be connected to the fuel injection valve mounted on the third cylinder. A pair of second supply tubes extending from the pair of second reference connection portions of the second distribution pipe may be connected to the pair of fuel injection valves mounted on the fifth and sixth cylinders, respectively. A first supply tube extending from the first connection portion of the second distribution pipe may be connected to the fuel injection valve mounted on the fourth cylinder.

According to the aforementioned configuration, the pair of first supply tubes extending from the pair of first reference connection portions of the first distribution pipe is connected to the pair of fuel injection valves mounted on the first and second cylinders. Accordingly, the pair of fuel injection valves mounted on the first and second cylinders may receive the supply of fuel through the pair of first supply tubes extending from the pair of first reference connection portions of the first distribution pipe. The second supply tube extending from the second connection portion of the first distribution pipe is connected to the fuel injection valve mounted on the third cylinder. Accordingly, the fuel injection valve mounted on the third cylinder may receive the supply of fuel through the second supply tube extending from the second connection portion of the first distribution pipe. The pair of second supply tubes extending from the pair of second reference connection portions of the second distribution pipe is connected to the pair of fuel injection valves mounted on the fifth and sixth cylinders. Accordingly, the pair of fuel injection valves mounted on the fifth and sixth cylinders may receive the supply of fuel through the pair of second supply tubes extending from the pair of second reference connection portions of the second distribution pipe. The first supply tube extending from the first connection portion of the second distribution pipe is connected to the fuel injection valve mounted on the fourth cylinder. Accordingly, the fuel injection valve mounted on the fourth cylinder may receive the supply of fuel through the first supply tube extending from the first connection portion of the second distribution pipe.

With respect to the aforementioned configuration, the engine may be formed of an in-line six-cylinder engine having six cylinders consisting of a first cylinder to a sixth cylinder as the cylinders. The first connection portions and the second connection portions may be alternately arranged in the arrangement direction. The first connection portions may be arranged in the arrangement direction at the distance between the bore center axes. The second connection portions may be arranged in the arrangement direction at the distance between the bore center axes. The first supply tubes may be connected to three fuel injection valves mounted on the first cylinder, the third cylinder and the fifth cylinder, respectively. The second supply tubes may be connected to three fuel injection valves mounted on the second cylinder, the fourth cylinder and the sixth cylinder, respectively.

According to the aforementioned configuration, the first connection portions arranged at intervals between the bore center axes and the second connection portions arranged at intervals between the bore center axes are alternately arranged in the arrangement direction, and the inclination direction of the first supply tubes connected to the first connection portions and the inclination direction of the second supply tubes connected to the second connection portions are opposite to each other. Accordingly, an operator may connect the first supply tubes to the fuel injection valves mounted on the first, third and fifth cylinders respectively, and may connect the second supply tubes to the fuel injection valves mounted on the second, fourth and sixth cylinders respectively.

INDUSTRIAL APPLICABILITY

The principles of the aforementioned embodiments may be suitably used for various vehicles.

The invention claimed is:

1. A fuel supply device configured to supply fuel to an engine having cylinders arranged at regular intervals in a predetermined arrangement direction, the fuel supply device comprising:

fuel injection valves respectively arranged on center axes of the cylinders, the fuel injection valves being configured to inject the fuel into the cylinders;

a fuel distribution portion configured to distribute the fuel to the fuel injection valves; and fuel supply tubes configured to form supply paths for the fuel from the fuel distribution portion to the fuel injection valves, wherein the fuel distribution portion includes connection portions arranged in the arrangement direction so as to be connected to the fuel supply tubes, wherein the connection portions include a pair of reference connection portions situated at positions distant from each other in the arrangement direction by a distance between respective bore center axes of the cylinders, and a middle connection portion situated between the pair of reference connection portions, wherein the fuel supply tubes include a pair of fuel supply tubes, each respectively connected to a corresponding one of the pair of reference connection portions and a corresponding one of two of the fuel injection valves on two of the cylinders arranged adjacently to each other, the pair of fuel supply tubes having a common shape, wherein the reference connection portions include first reference connection portions and second reference connection portions, wherein one of the fuel supply tubes extends from the middle connection portion between the pair of reference connection portions so as to cross as viewed from above in a cylinder axis direction with the fuel supply tube connected to one of the two fuel injection valves, the one of the fuel supply tubes being connected to another of the fuel injection valves arranged adjacently to the one of the two fuel injection valves, wherein the fuel supply tubes include first supply tubes each of which has a first shape formed so as to connect a respective one of the fuel injection valves and a corresponding one of the connection portions, which are distant from each other by a first predetermined distance, and second fuel supply tubes each of which has a second shape different from the first shape, the second shape being formed so as to connect a respective one of the fuel injection valves and a corresponding one of the connection portions, which are distant from each other by a second predetermined distance different from the first predetermined distance, wherein the connection portions include first connection portions to which the first supply tubes are connected, and second connection portions to which the second supply tubes are connected, wherein the first connection portions include a pair of the first reference connection portions distant from each other in the arrangement direction by the distance between the respective bore center axes of the cylinders, wherein the second connection portions include a pair of the second reference connection portions distant from each other in the arrangement direction by the distance between the respective bore center axes of the cylinders, wherein the fuel distribution portion includes a first distribution pipe which has the pair of the first reference connection portions, and a second distribution pipe which is arranged at an interval from the first distribution pipe and has the pair of the second reference connection portions, the first and second distribution pipes being arranged in series, wherein one of the second connection portions is situated at a middle position between the pair of the first reference connection portions of the first distribution pipe, wherein one of the first connection portions is situated at a middle position between the pair of the second reference connection portions of the second distribution pipe, and wherein a distance between the first and second distribution pipes is set such that the second connection portion of the first distribution pipe is distant from one of the fuel injection valves by the second predetermined distance, and the first connection portion of the second distribution pipe is distant from another of the fuel injection valves by the first predetermined distance.

2. The fuel supply device for the engine according to claim 1, wherein the fuel distribution portion extends along an extension axis which extends in the arrangement direction, wherein each of the first supply tubes is connected to a corresponding one of the fuel injection valves and a corresponding one of the first connection portions which is situated at a position that is off from the fuel injection valve in a first direction along the extension axis, and wherein each of the second supply tubes is connected to a corresponding one of the fuel injection valves and a corresponding one of the second connection portions which is situated at a position that is off from the fuel injection valve in a second direction opposite to the first direction along the extension axis.

3. The fuel supply device for the engine according to claim 1, wherein the second distribution pipe has a shape in common with the first distribution pipe.

4. The fuel supply device for the engine according to claim 1, wherein the engine is formed of an in-line six-cylinder engine having six cylinders consisting of a first cylinder to a sixth cylinder as the cylinders, wherein the fuel injection valves are formed of six fuel injection valves mounted on the first cylinder, the second cylinder, the third cylinder, the fourth cylinder, the fifth cylinder and the sixth cylinder, respectively, wherein the fuel is distributed to the three fuel injection valves mounted on the first cylinder, the second cylinder and the third cylinder through the first distribution pipe, wherein the fuel is distributed to the three fuel injection valves mounted on the fourth cylinder, the fifth cylinder and the sixth cylinder through the second distribution pipe, wherein a pair of the first supply tubes extending from the pair of first reference connection portions of the first distribution pipe is connected to a first corresponding pair of the fuel injection valves mounted on the first and second cylinders, respectively, wherein one of the second supply tubes extending from the second connection portion of the first distribution pipe is connected to the fuel injection valve mounted on the third cylinder, wherein a pair of the second supply tubes extending from the pair of second reference connection portions of the second distribution pipe is connected to a second corresponding pair of the fuel injection valves mounted on the fifth and sixth cylinders, respectively, and wherein one of the first supply tubes extending from the first connection portion of the second distribution pipe is connected to the fuel injection valve mounted on the fourth cylinder.

5. A fuel supply device configured to supply fuel to an engine having cylinders arranged at regular intervals in a predetermined arrangement direction, the fuel supply device comprising:

fuel injection valves respectively arranged on center axes of the cylinders, the fuel injection valves being configured to inject the fuel into the cylinders;

a fuel distribution portion configured to distribute the fuel to the fuel injection valves; and fuel supply tubes configured to form supply paths for the fuel from the fuel distribution portion to the fuel injection valves, wherein the fuel distribution portion includes connection portions arranged in the arrangement direction so as to be connected to the fuel supply tubes, wherein the connection portions include a pair of reference connection portions situated at positions distant from each other in the arrangement direction by a distance between respective bore center axes of the cylinders, wherein the fuel supply tubes include a pair of fuel supply tubes, each respectively connected to a corresponding one of the pair of reference connection portions and a corresponding one of two of the fuel injection valves on two of the cylinders arranged adjacently to each other, the pair of fuel supply tubes having a common shape, wherein the reference connection portions include first reference connection portions and second reference connection portions, wherein the fuel supply tubes include first supply tubes each of which has a first shape formed so as to connect a respective one of the fuel injection valves and a corresponding one of the connection portions, which are distant from each other by a first predetermined distance, and second fuel supply tubes each of which has a second shape different from the first shape, the second shape being formed so as to connect a respective one of the fuel injection valves and a corresponding one of the connection portions, which are distant from each other by a second predetermined distance different from the first predetermined distance, wherein the connection portions include first connection portions to which the first supply tubes are connected, and second connection portions to which the second supply tubes are connected, wherein the first connection portions include a pair of the first reference connection portions distant from each other in the arrangement direction by the distance between the respective bore center axes of the cylinders, wherein the second connection portions include a pair of the second reference connection portions distant from each other in the arrangement direction by the distance between the respective bore center axes of the cylinders, wherein the fuel distribution portion includes a first distribution pipe which has the pair of the first reference connection portions, and a second distribution pipe which is arranged at an interval from the first distribution pipe and has the pair of the second reference connection portions, the first and second distribution pipes being arranged in series, wherein one of the second connection portions is situated at a middle position between the pair of the first reference connection portions of the first distribution pipe, wherein one of the first connection portions is situated at a middle position between the pair of the second reference connection portions of the second distribution pipe, and wherein a distance between the first and second distribution pipes is set such that the second connection portion of the first distribution pipe is distant from one of the fuel injection valves by the second predetermined distance, and the first connection portion of the second distribution pipe is distant from another of the fuel injection valves by the first predetermined distance.

6. The fuel supply device for the engine according to claim 5, wherein the second distribution pipe has a shape in common with the first distribution pipe.

7. The fuel supply device for the engine according to claim 5, wherein the engine is formed of an in-line six-cylinder engine having six cylinders consisting of a first cylinder to a sixth cylinder as the cylinders, wherein the fuel injection valves are formed of six fuel injection valves mounted on the first cylinder, the second cylinder, the third cylinder, the fourth cylinder, the fifth cylinder and the sixth cylinder, respectively, wherein the fuel is distributed to the three fuel injection valves mounted on the first cylinder, the second cylinder and the third cylinder through the first distribution pipe, wherein the fuel is distributed to the three fuel injection valves mounted on the fourth cylinder, the fifth cylinder and the sixth cylinder through the second distribution pipe, wherein a pair of the first supply tubes extending from the pair of the first reference connection portions of the first distribution pipe is connected to a corresponding first pair of the fuel injection valves mounted on the first and second cylinders, respectively, wherein one of the second supply tubes extending from the second connection portion of the first distribution pipe is connected to the fuel injection valves mounted on the third cylinder, wherein a pair of the second supply tubes extending from the pair of the second reference connection portions of the second distribution pipe is connected to a corresponding second pair of the fuel injection valves mounted on the fifth and sixth cylinders, respectively, and wherein one of the first supply tubes extending from the first connection portion of the second distribution pipe is connected to the fuel injection valve mounted on the fourth cylinder.

* * * * *